US011266000B2

(12) United States Patent
Chen et al.

(10) Patent No.: US 11,266,000 B2
(45) Date of Patent: Mar. 1, 2022

(54) X-RAY TUBE DEVICE AND SPRING PIN

(71) Applicant: NUCTECH COMPANY LIMITED, Beijing (CN)

(72) Inventors: Zhiqiang Chen, Beijing (CN); Wanlong Wu, Beijing (CN); Fuhua Ding, Beijing (CN); Wenguo Liu, Beijing (CN); Zhimin Zheng, Beijing (CN); Shuo Cao, Beijing (CN)

(73) Assignee: Nuctech Company Limited, Beijing (CN)

( * ) Notice: Subject to any disclaimer, the term of this patent is extended or adjusted under 35 U.S.C. 154(b) by 786 days.

(21) Appl. No.: 16/074,938

(22) PCT Filed: Apr. 4, 2018

(86) PCT No.: PCT/CN2018/081833

§ 371 (c)(1),
(2) Date: Aug. 2, 2018

(87) PCT Pub. No.: WO2018/184554

PCT Pub. Date: Oct. 11, 2018

(65) Prior Publication Data

US 2021/0204385 A1 Jul. 1, 2021

(30) Foreign Application Priority Data

Apr. 6, 2017 (CN) ..... 201710220111.7

(51) Int. Cl.

| | |
|---|---|
| ***H05G 1/04*** | (2006.01) |
| *H01J 35/12* | (2006.01) |
| *H05G 1/10* | (2006.01) |

(52) U.S. Cl.

CPC ..... *H05G 1/04* (2013.01); *H01J 35/12* (2013.01); *H05G 1/10* (2013.01)

(58) Field of Classification Search

CPC ..... H05G 1/04

See application file for complete search history.

(56) References Cited

U.S. PATENT DOCUMENTS

| | | | | |
|---|---|---|---|---|
| 9,882,301 | B1 * | 1/2018 | Emaci | H01R 13/2421 |
| 2012/0106713 | A1 * | 5/2012 | Parker | H01J 35/165 378/140 |

(Continued)

FOREIGN PATENT DOCUMENTS

| | | | |
|---|---|---|---|
| CN | 201146273 | Y | 11/2008 |
| CN | 201277905 | Y | 7/2009 |

(Continued)

OTHER PUBLICATIONS

Machine translation of CN 201146273 Y (Year: 2008).*

(Continued)

*Primary Examiner* — Chih-Cheng Kao

(74) *Attorney, Agent, or Firm* — Merchant & Gould P.C.

(57) ABSTRACT

The present disclosure provides an X-ray tube device and a spring pin for an X-ray tube device. In an embodiment, the X-ray tube device includes: an outer cylinder assembly having an anode end and a cathode end, an anode end cap assembly provided at the anode end of the outer cylinder assembly and including an X-ray tube, a cathode end cap assembly provided at the cathode end of the outer cylinder assembly and including a high voltage receptacle for an external power supply, and a spring pin connection assembly provided in the outer cylinder assembly and connecting a filament lead of the X-ray tube to the high voltage receptacle.

6 Claims, 3 Drawing Sheets

(56) References Cited

U.S. PATENT DOCUMENTS

| | | | | |
|---|---|---|---|---|
| 2013/0163725 | A1* | 6/2013 | Hansen | H01R 13/53 378/101 |
| 2015/0371809 | A1* | 12/2015 | Ding | H01J 35/13 378/101 |

FOREIGN PATENT DOCUMENTS

| | | | |
|---|---|---|---|
| CN | 201780961 | U | 3/2011 |
| CN | 103997839 | A | 8/2014 |
| CN | 104012182 | A | 8/2014 |
| CN | 106851950 | A | 6/2017 |
| CN | 206775811 | U | 12/2017 |
| SU | 351264 | A | 9/1972 |

OTHER PUBLICATIONS

International Search Report and Written Opinion of the International Searching Authority for International Patent Application No. PCT/CN2018/081833 dated Jul. 9, 2018, 12 pages.
Russian Office Action for corresponding Russian Patent Application No. 2018129295/07(047136) dated Jul. 10, 2019, 9 pages.

* cited by examiner

X-RAY TUBE DEVICE AND SPRING PIN

This application is a National Stage Application of PCT/CN2018/081833, filed 4 Apr. 2018, which claims benefit of Serial No. 201710220111.7, filed 6 Apr. 2017 in China, and which applications are incorporated herein by reference. A claim of priority is made to each of the above-disclosed applications.

TECHNICAL FIELD

The present disclosure relates to the technical field of X-ray generator, and particularly to a closed X-ray tube device and a spring pin for a closed X-ray tube device.

BACKGROUND ART

X-ray tubes that may emit X-rays are widely used in the fields of security inspection, medical research, nondestructive detection, etc., and have high commercial value. It is desired in prior art to further improve and perfect the performance and reliability of X-ray tube devices.

SUMMARY OF THE INVENTION

According to an aspect of the present disclosure, there is provided an X-ray tube device comprising:

an outer cylinder assembly having an anode end and a cathode end;

an anode end cap assembly provided at the anode end of the outer cylinder assembly and comprising an X-ray tube;

a cathode end cap assembly provided at the cathode end of the outer cylinder assembly and including a high voltage receptacle for connecting an external power supply; and a spring pin connection assembly provided in the outer cylinder assembly and configured to connect a filament lead of the X-ray tube to the high voltage receptacle.

In some embodiments, the spring pin connection assembly includes: a filament switch receptacle connected to the filament lead of the X-ray tube; a filament switch plug connected into the filament switch receptacle; a spring pin switch receptacle connected to the high voltage receptacle; and a spring pin provided between the filament switch plug and the spring pin switch receptacle and configured to connect the filament switch plug with the spring pin switch receptacle.

In some embodiments, the spring pin switch receptacle is provided with a mounting hole in which the spring pin is embedded, and a lead of the high voltage receptacle is welded to the spring pin.

In some embodiments, the filament switch plug and the spring pin are made of a copper material plated with nickel and gold.

In some embodiments, the filament switch receptacle and the spring pin switch receptacle each are formed with a through hole.

In some embodiments, the spring pin may include: a contact having a head portion and an abutting portion, the head portion being in contact and connection with the filament switch plug, and the abutting portion defining an inclined surface; a pin tubing, wherein the abutting portion of the contact is in contact and connection with an inner wall of the pin tubing; and a spring provided in the pin tubing and elastically pressing against the inclined surface of the abutting portion.

In some embodiments, the spring pin may further include a force applying mechanism formed in the abutting portion of the contact and configured to drive the abutting portion of the contact to reliably contact and connect the inner wall of the pin tubing, the force applying mechanism including: an hole opened in the abutting portion of the contact; a spring provided in the hole; a ball provided in the hole and in contact with the inner wall of the pin tubing; and a baffle plate provided between the spring and the ball; wherein one end of the spring is in contact with a bottom of the hole, while the other end thereof is elastically abutted against the ball by the baffle plate.

In some embodiments, the outer cylinder assembly may include a metal outer cylinder and a beam guide window that is formed at a beam outgoing slit of the metal outer cylinder.

In some embodiments, the anode end cap assembly may include: an anode end cap provided at an anode end of the metal outer cylinder; and the X-ray tube located in the metal outer cylinder and fixed to the anode end cap.

In some embodiments, the cathode end cap assembly may include: a cathode end cap provided at a cathode end of the metal outer cylinder, the high voltage receptacle and an elastic tympanic membrane provided in the metal outer cylinder.

In some embodiments, the X-ray tube device may further include a heat pipe dissipater provided at the anode end cap. The heat pipe dissipater may further include: a heat pipe having an evaporation end and a condensation end; a clamping plate, wherein a heat receiving end surface of the clamping plate is in contact and connection with the evaporation end of the heat pipe, and a heat dissipating end surface of the clamping plate is in contact and connection with a heat dissipating boss of the anode end cap; fins arranged at the condensation end of the heat pipe; and a fan connected to the fins.

In some embodiments, the X-ray tube device may further include a circulating cooling device in communication with a circulating cooling channel formed in the anode end cap. The circulating cooling device may further include a vacuum pump, a heat dissipater and a cooling fan, wherein coolant liquid in the circulating cooling channel flows through the heat dissipater driven by the vacuum pump, dissipates heat by means of the cooling fan, and flows back to the circulating cooling channel after being cooled, forming a circulating cooling loop.

According to another aspect of the present disclosure, there is provided a spring pin for an X-ray tube device, wherein the spring pin includes: a contact having a head portion and an abutting portion, the head portion being in contact and connection with a filament switch plug, and the abutting portion defining an inclined surface; a pin tubing, wherein the abutting portion of the contact is in contact and connection with an inner wall of the pin tubing; and a spring provided in the pin tubing and elastically pressing against the inclined surface of the abutting portion.

In some embodiments, the spring pin may further include a force applying mechanism formed in the abutting portion of the contact and configured to drive the abutting portion of the contact to reliably contact and connect the inner wall of the pin tubing. The force applying mechanism may include: an hole opened in the abutting portion of the contact; a spring provided in the hole; a ball provided in the hole and in contact with the inner wall of the pin tubing; and a baffle plate provided between the spring and the ball; wherein one end of the spring is in contact with a bottom of the hole, while the other end thereof is elastically abutted against the ball via the baffle plate.

BRIEF DESCRIPTION OF THE DRAWINGS

Hereinafter, the present disclosure will be further described with reference to the drawings and specific embodiments, in which.

DETAILED DESCRIPTION OF EMBODIMENTS OF THE INVENTION

Hereinafter, the technical solution of the present disclosure will be further described in detail through embodiments in conjunction with the drawings. The following description of the embodiments of the present disclosure with reference to the drawings is intended to explain the general inventive concept of the present disclosure and should not be construed as limiting the present disclosure.

Figure 1:
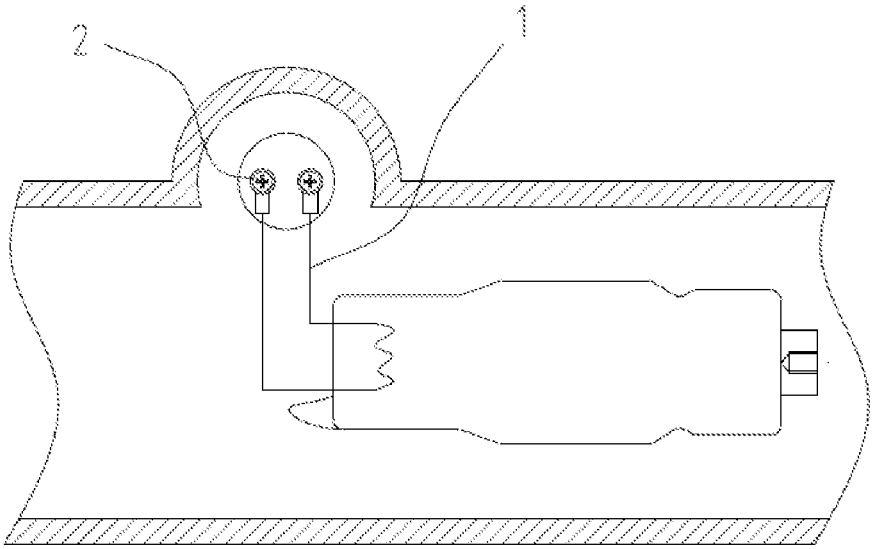
FIG. 1 is a schematic diagram illustrating configuration of a filament lead in a conventional X-ray tube device.

In order to facilitate understanding the technical solution of the present disclosure, an X-ray tube in the prior art will be introduced first. As shown in FIG. 1, in a conventional closed X-ray tube device, a filament lead 1 of the X-ray tube is usually adapted to be connected with an external receptacle by means of fastening by a screw 2. In addition, it is also possible to employ the ways of manual tin soldering, pipe wrench press-fitting, plugging, etc. However, when these ways are applied, operating space is needed to pre-set and reserve, which usually causes problems such as increased size of the device, abnormal shape of a shell, deviation of wires, and inconvenience of assembly and disassembly, etc., and even a potential risk of loosening and detachment. There are a few ways of using coaxial adapters, but such ways usually lead to rigid limitation of position, and even lead to damage of the X-ray tube body due to a slight misalignment.

In addition, a conventional spring pin is mainly composed of three parts: a contact, a pin tubing and a spring. Because of its characteristics of stability, reliability, compactness, convenience and low cost, etc., a spring pin has been widely used in many fields. In order to achieve more reliable contact between the contact and the pin tubing inner wall, and thus to reduce the contact resistance and improve electrical conduction stability, conventional improvements are to cut contact surfaces of the contact and the spring from planar surfaces into inclined surfaces. Such simple improvement still cannot eradicate the problems such as movement, friction and conduction instability caused by stress dispersion of the spring. The contact between the contact and pin tubing is still not stable and reliable enough.

Figure 2:
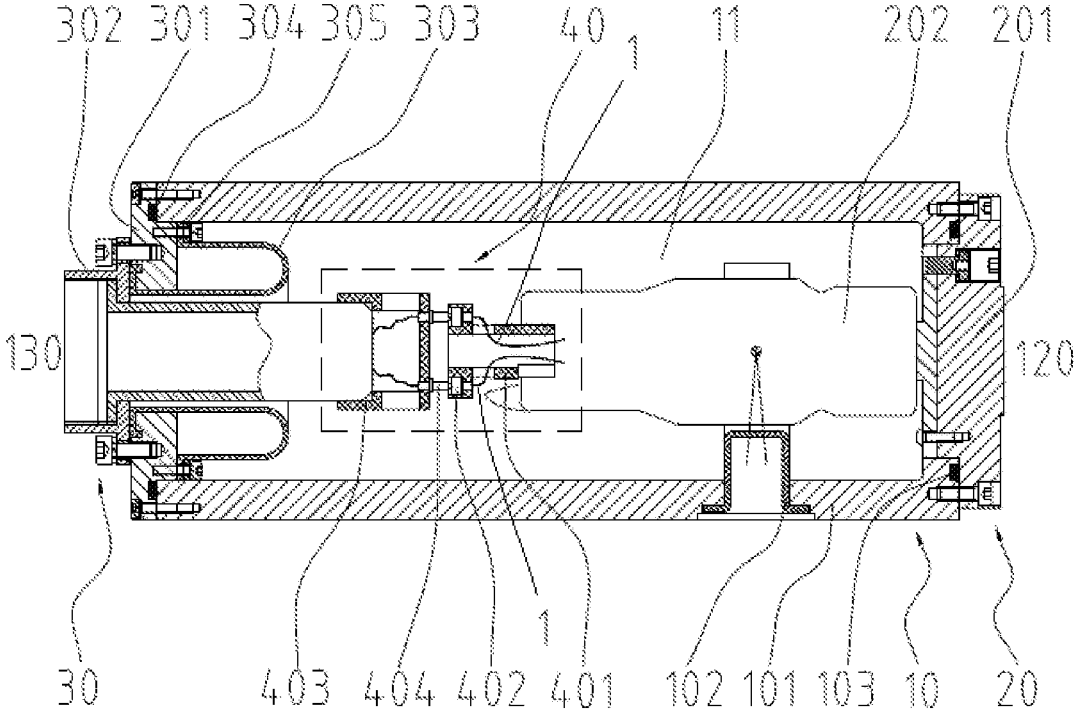
FIG. 2 is a structural schematic view of an X-ray tube device according to an embodiment of the present disclosure.

Referring to FIG. 2, it shows a structural schematic view of an X-ray tube device according to an embodiment of the present disclosure. The X-ray tube device includes: a metal outer cylinder assembly 10, it mainly having a metal outer cylinder 101, with a beam outgoing slit, and a beam guide window 102 for sealing the slit; an anode end cap assembly 20 mainly including an anode end cap 201 and an X-ray tube 202 that is located in the metal outer cylinder 101 and fixed on the anode end cap 201, etc.; a cathode end cap assembly 30 mainly including a cathode end cap 301, a high voltage receptacle 302 for connecting an external power supply, and an oil-resistant elastic tympanic membrane 303 extendable freely following a pressure change in the closed cavity of the metal outer cylinder 101; and, a spring pin connection assembly 40 mainly including a filament connection receptacle 401 and a filament connection plug 402 embedded in the filament connection receptacle 401, a spring pin connection receptacle 403, and a spring pin 404 embedded in the spring pin connection receptacle 403 for carrying electric current, etc.

As shown in FIG. 2, the beam guide window 102 is sealed on the metal outer cylinder 101 with an oil-resistant glue, and then the anode end cap assembly 20 is fastened to an anode end 120 of the metal outer cylinder 101 by a screw, and the cathode end cap assembly 30 is fastened to a cathode end 130 of the metal outer cylinder 101 by a screw. The filament lead 1 of the X-ray tube 202 is connected to the high voltage receptacle 302 through the spring pin connection assembly 40. In the X-ray tube device provided by the present disclosure, a metal enclosed cavity is formed by the above components, and is needed to be vacuumized and fully filled with an insulating medium 11 such as transformer oil. An X-ray beam within a desired range of a flare angle will be generated by embedding a corresponding front-end collimator in the beam guide window 102 in the X-ray tube device present disclosure and applying a high voltage electric field across the ends of the device provided by the present disclosure.

Further, in the X-ray tube device provided by the present disclosure, an O-ring 103 is sandwiched between the anode end 120 of the metal outer cylinder 101 and the anode end cap 201, and an O-ring 304 is sandwiched between the cathode end 130 of the metal outer cylinder 101 and the cathode end cap 301 so as to achieve an effect of vacuum sealing. In a specific embodiment, the O-rings 103, 304 are made of such as oil-resistant fluoro rubber. As shown in FIG. 2, the aforementioned O-rings 103, 304 are respectively located at an anode end surface of the metal outer cylinder 101 and a periphery of the cathode end cap 301. However, the present disclosure is not limited to this. For example, the O-rings 103, 304 each may also be located on a cathode end surface of the metal outer cylinder 101, an inner end surface or a periphery of the anode end cap 201, and an inner end surface of the cathode end cap 301.

As shown in FIG. 2, a shape of the metal outer cylinder assembly 10 as a whole is generally cylindrical, and it has necessary capability of radiation shielding and heat conduction/dissipation, while minimizing the X-ray attenuation effect.

In an embodiment, the metal outer cylinder 101 may be made of copper material as a whole, which not only satisfies the aforementioned requirements but also is easy to be processed and assembled. However, the present disclosure is not limited to this. For example, the metal outer cylinder 101 may be made of other non-copper materials that have similar properties. In another example, the metal outer cylinder 101 may also be formed by laminated materials of different kinds, specifically such as a stainless steel outer cylinder lined with a lead layer, or other materials having the capability of radiation shielding.

Further, as shown in FIG. 2, the beam guide window 102 has a hollow convex shape with a flange, thereby not only reducing the X-ray absorption and blockage by obstacles outside the target and effectively preventing attenuation of the X-ray, but also reliably sealing the insulating medium 11 such as the transformer oil in the closed cavity. More specifically, the beam guide window 102 is made of polycarbonate, and is bonded around a slit of the metal outer cylinder 101 by an oil-resistant epoxy glue.

Figure 3:
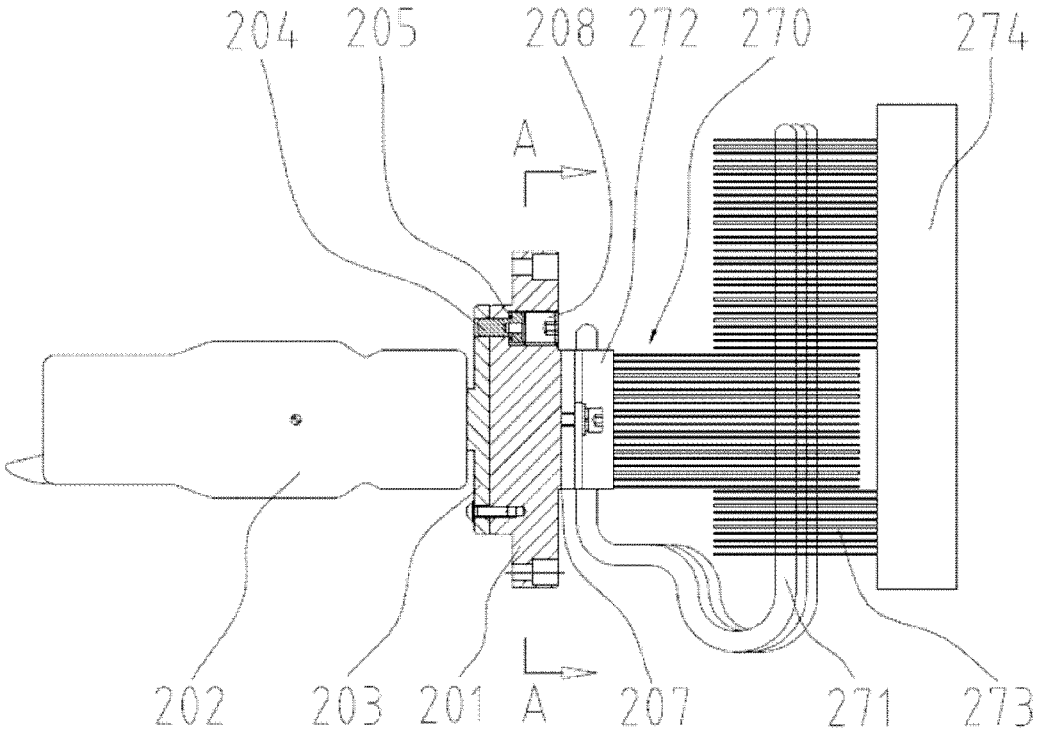
FIG. 3 is a structural schematic view of an anode end cap assembly and a heat pipe dissipater in the X-ray tube device shown in FIG. 2.

FIG. 3 is a structural schematic view of the anode end cap assembly 20 and a heat pipe dissipater 270 in the X-ray tube device shown in FIG. 2. As shown in FIG. 3, the X-ray tube 202 is fixed to the anode end cap 201 with its anode rod flange 203 by a screw, for generating an X-ray beam. It is well known that when high-speed electrons impinges an anode target, less than 1% of the kinetic energy of the electrons is converted to X-ray, while more than 99% of the energy is transformed to heat. It can be seen that the heat energy generated by the X-ray tube is concentrated at the anode rod. The heat is needed to be conducted through the anode cap 201 and dissipated away in time, otherwise the temperature of the target would be too high would be damaged due to ablation. Therefore, a heat dissipating device is needed to be provided on the anode end cap 201. In order to achieve both an effective radiation shielding and heat dissipating, the anode end cap 201 may be made of a copper material and is provided with a vacuum oil injection hole 208.

In the X-ray tube device provided by the present disclosure, the anode cap 201 is made of a metal material. As shown in FIG. 3, an outer end surface of the anode end cap 201 is provided with a heat dissipating boss 207, which may be connected with a conductive heat pipe dissipater 270. In a specific embodiment, the conductive heat pipe dissipater 270 includes a heat pipe 271, a clamping plate 272, fins 273 and a fan 274. The clamping plate 272 is used to fix an evaporation end of the heat pipe 271. The fins 273 are arranged at a condensation end of heat pipe 271 so as to increase the heat dissipating area. A heat dissipating end surface of the clamping plate 272 and the heat dissipating boss 207 are fixed together by a screw, and an appropriate amount of thermal conductive silicone grease is evenly applied between them. In this manner, by providing the aforementioned conductive heat pipe dissipater 270, the heat energy of the anode rod of the X-ray tube 202 may be rapidly transferred to the anode end cap 201, and then to the heat dissipating fins 273 by the heat-absorptive vaporization and condensation backflow of the heat pipe 271. Further, a fan 274 is provided to form convection with peripheral cold air so that a good heat dissipating effect could be achieved. This heat dissipating manner involves less intermediate links, and thus is more simple and reliable.

Figure 4:
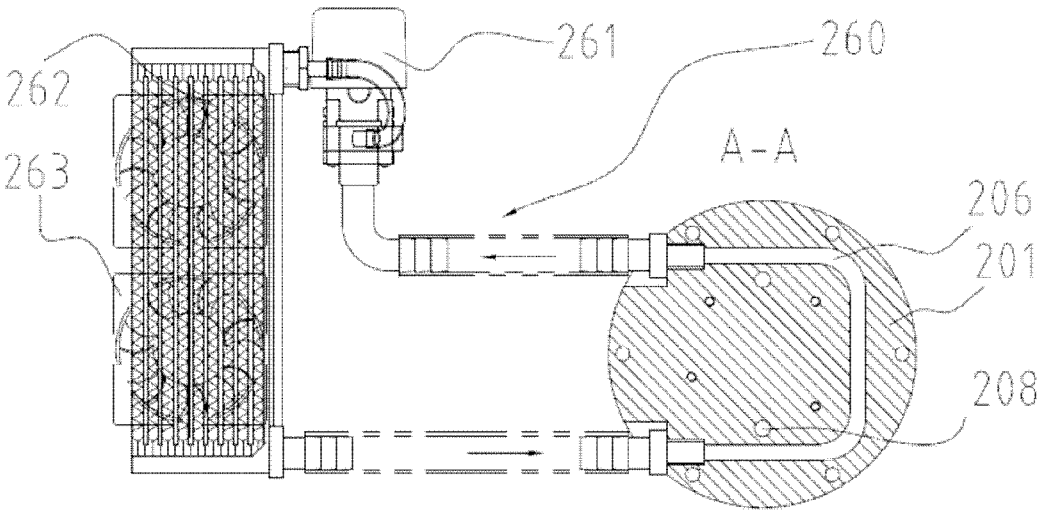
FIG. 4 is a cut-away view taken along the line A-A in FIG. 3, showing a structural schematic view of the anode end cap and the circulating cooling device.

In the X-ray tube device provided by the present disclosure, FIG. 4 is a cut-away view taken along the line A-A in FIG. 3, showing a structural schematic view of the anode end cap 201 and a circulating cooling device 260. As shown in FIG. 4, the anode end cap 201 is designed with a circulating cooling channel 206 therein, which may be connected externally to the circulating cooling device 260. In a specific embodiment, the circulating cooling device 260 includes a vacuum pump 261, a laminar flow heat dissipater 262 having a large dissipating area, a fan 263, and corresponding conduit and adapters. In this manner, by providing the aforementioned circulating cooling device 260, the heat of the anode rod of the X-ray tube 202 may be transferred to the anode end cap 201, and delivered to the laminar flow heat dissipater 262 by a cooling liquid in the circulating cooling channel 206, and then may be exchanged with outer cold air by means of the cooling fan 263. The cooling liquid that has been cooled flows back, thereby forming a circulating cooling loop with a remarkable heat dissipating effect.

Specifically, the X-ray tube device provided by the present disclosure may use one or both of the aforementioned heat pipe dissipater 270 and the aforementioned circulating cooling device 260, depending on the external conditions and system requirements as applied.

In the X-ray tube device provided by the present disclosure, as shown in FIG. 3, the anode end cap 201 has two vacuum oil injection holes 208 for the oiling injection operation of the vacuum X-ray tube device, and inner end of the vacuum oil injection holes 208 is a smooth circular hole while outer end of them is a threaded hole. After the oiling injection operation is completed, a T-shaped sealing plug 204 is covered with an oil-resistant fluoro rubber O-ring 205 and then inserted into the vacuum oil injection hole 208; a flat-end screw is then screwed into the threaded hole and fastened. With the configuration, leakage of the insulating medium 11 such as internal transformer oil may be effectively avoided.

The X-ray tube of the anode end cap assembly is used to generate an X-ray beam, and the generated heat energy that is lost is concentrated on the anode and the target thereof and then dissipated through thermal conduction of the anode end cap. Therefore, the anode end cap is designed with a heat dissipating channel and a heat dissipating end surface, which may be used for connecting externally to circulating cooling devices and conductive heat dissipaters, and vacuum oiling injection ports are preset.

In the X-ray tube device provided by the present disclosure, as described above, the cathode end cap assembly 30 mainly includes a cathode end cap 301, a high voltage receptacle 302 connected externally to a negative high voltage power supply, and an oil-resistant elastic tympanic membrane 303 extendable freely following a pressure change in the closed cavity. The cathode end cap assembly is needed to be connected externally to an external negative high voltage power supply, may be adapted to thermal expansion and contraction of the insulating medium such as the internal transformer oil when the X-ray tube is in operation, and itself has an oil-resistant sealing function. Therefore, the cathode end cap needs to be equipped with a high voltage receptacle and an oil-resistant elastic tympanic membrane.

As shown in FIG. 2, an outer portion of the elastic tympanic membrane 303 is turned up as an outer flange, and then fastened to the cathode end cap 301 by a pressure ring 305. A shallow groove is designed on the outer end surface of the cathode end cap 301, and an inner flange of the elastic tympanic membrane 303 is pressed and fixed into the shallow groove by a flange of the high voltage receptacle 302, and a thickness of the inner flange is slightly greater than a depth of the aforementioned shallow groove such that a suitable compressed amount may be reserved enhancing the sealing effect. The elastic tympanic membrane is resistant to corrosion of the insulating medium 11 such as transformer oil, and has an appropriate flexibility. In an embodiment, the tympanic membrane 303 is made of a fluoro rubber material. The X-ray tube is fastened to the anode end cap with its anode rod flange by a screw, and the flare angle of the beam of the X-ray tube is ensured to be aligned with a direction of an opening angle of the outer tube slit. Because an insulating medium such as transformer oil in a closed cavity is provided at one side of the elastic tympanic membrane, while normal air outside the closed cavity is at the other side thereof, seal property is needed to consider.

Further, a periphery of the inner end surface of the cathode end cap 301 may have an O-ring groove. Further, when the cathode end cap assembly 30 and the anode end cap 201 are respectively fastened to opposite ends of the metal outer cylinder 101, an oil-resistant rubber therebetween is needed to improve sealing effect. Specifically, the O-ring groove may be provided in the anode end cap, the cathode end cap, or both end surfaces of the metal outer cylinder.

Figure 5:
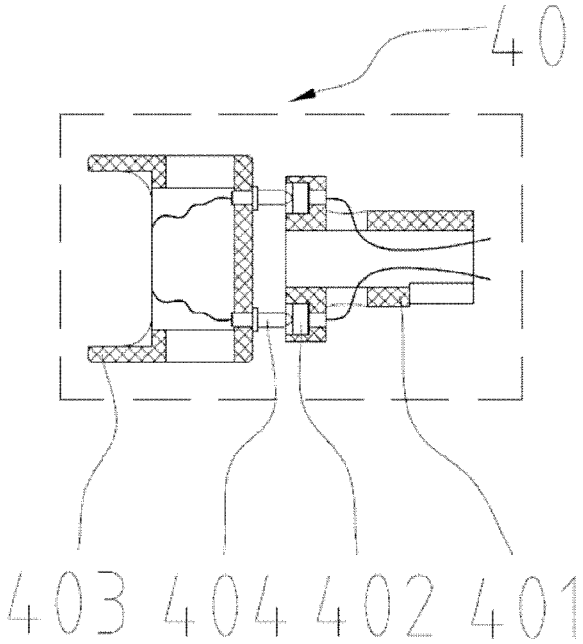
FIG. 5 is an enlarged structural schematic view of a spring pin connection assembly in the X-ray tube device shown in FIG. 2.

FIG. 5 is an enlarged structural schematic view of a spring pin connection assembly 40 as shown in a dashed rectangular frame in the X-ray tube device shown in FIG. 2. The spring pin connection assembly 40 enables a free engagement of the anode end cap assembly 20 and the cathode end cap assembly 30, and ensures a reliable electric conduction between the high voltage receptacle 302 and the filament lead of the X-ray tube 202. As previously described, the spring pin connection assembly 40 mainly includes: a filament connection receptacle 401 for connecting to the filament lead 1 of the X-ray tube 202, a filament connection plug 402 embedded in the filament connection receptacle 401, a spring pin connection receptacle 403 for connecting to the high voltage receptacle 302, and a spring pin 404 embedded in the spring pin connection receptacle 403 and connected to the filament connection plug 402 for carrying electric current, etc.

In a specific embodiment, the filament connection receptacle 401 is fixed to a filament lead end of the X-ray tube 202, the filament connection plug 402 is embedded in from its top, and the filament lead 1 is welded to a bottom of the filament connection plug 402. An end surface of the filament connection plug 402 is slightly lower than an end surface of the filament connection receptacle 401, thereby forming a circular recess that facilitates positioning of a contact 441 of the spring pin 404 during assembly.

In a specific embodiment, a mounting hole is provided at a top of the spring pin connection receptacle 403, a spring pin 404 is embedded into the mounting hole for carrying electric current, and then the spring pin connection receptacle 403 is covered and mounted on the cylindrical lead end of the high voltage receptacle 302, and a lead of the high voltage receptacle 302 is welded to bottom of the spring pin 404.

Further, the spring pin 404 is made of a copper material, a whole surface of the spring pin 404 is plated with nickel firstly and then plated with gold so as to improve mechanical, chemical and electrical performance.

Further, the filament connection plug 402 and the spring pin 404 are made of a copper material, a whole surface of them is plated with nickel firstly and then plated with gold so as to improve mechanical and electrical performance.

Further, the filament connection receptacle 401 and the spring pin connection receptacle 403 each have a through hole, which not only facilitates assembling, but also ensures that the insulating medium 11 such as transformer oil may smoothly flow into relevant gaps, in order to completely eliminate residual air during oil filling operation. Both of them are made of materials that are resistant to oil and radiation, and have strong capability of electrical insulation.

Further, all of the filament connection receptacle 401, the filament connection plug 402, the spring pin connection receptacle 403 and the spring pin 404 are needed to be assembled neatly to avoid the phenomenon of deflection, thereby maintaining practical effect. This requirement may be met by associated assembly fixtures.

Figure 6:
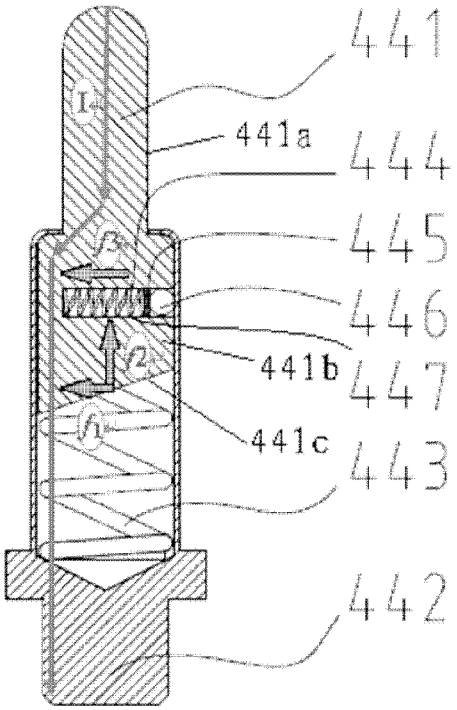
FIG. 6 is an enlarged structural schematic view of the spring pin in the spring pin connection assembly shown in FIG. 5.

FIG. 6 is an enlarged structural schematic view of the spring pin 404 in the spring pin connection assembly shown in FIG. 5. Specifically, the spring pin 404 mainly includes a contact 441, a pin tubing 442 and a spring 443, etc. In the X-ray tube device provided by the present disclosure, the spring pin connection assembly 40 carries a large filament electric current. At their junction, the electric current is conducted mainly through the contact between the contact 441 of the spring pin 404 and an end surface of the filament connection plug 402. The characteristics of the spring 443 are not suitable for carrying a large electric current, otherwise its mechanical performance would be affected due to high temperature, and even lead to ablation damage. A contact surface between the contact 441 and an inner wall of the pin tubing 442 serves as a main carrier of the carried current, and a reliable contact is required.

In an embodiment, the spring pin 404 mainly includes a contact 441, a pin tubing 442 and a spring 443. The contact 441 has a head portion 441*a* and an abutting portion 441*b*, wherein the head portion 441*a* is in contact and connection with the filament connection plug 402, and the abutting portion 441*b* defines an inclined surface 441*c*. The abutting portion 441*b* of the contact 441 is in contact and connection with the inner wall of the pin tubing 442. The spring 443 is provided in the pin tubing 442 and elastically presses against the inclined surface 441*c* of the abutting portion 44 lb.

In a specific embodiment, one end of the contact 441 in contact with the filament connection plug 402 is the head portion 441*a* having an arc surface, and with this configuration, the electric conductivity and applicability may be enhanced. The other end of the contact 441 in contact with the spring 443 is the abutting portion 441*b* defining the inclined surface 441*c*, and with this configuration, fitting effect of the contact 441 and the inner wall of the pin tubing 442 may be improved; the bottom of the pin tubing 442 is designed to be taper-shaped, which can stabilize the spring 443 much better.

Further, as shown in FIG. 6, the spring pin 404 may further include a force applying mechanism, which is formed in the abutting portion 441*b* of the contact 441 and used to drive the abutting portion 441*b* of the contact 441 to reliably contact and connect the inner wall of the pin tubing 442. Specifically, the force applying mechanism may include: a hole 447 opened in the abutting portion 441*b* of the contact 441; a spring 444 provided in the hole 447; a ball 446 provided in the hole 447 and in contact with the inner wall of the pin tubing 442; and a baffle plate 445 provided between the spring 444 and the ball 446; wherein one end of the spring 444 is in contact with the bottom of the hole 447, while the other end thereof is elastically abutted against the ball 446 via the baffle plate 445.

In a specific embodiment, as shown in FIG. 6, the abutting portion 441*b* of the contact 441 is opened laterally with a round blind hole (i.e., an hole) 447, in which a side-push spring 444 is embedded. One end of the side-push spring 444 is in contact with the bottom of the blind hole, while the other end thereof is blocked inside the blind hole by the baffle plate 445. One side of the solid ball 446 is in contact with the baffle plate 445, while the other side thereof is in contact with the inner wall of the pin tubing 442. Referring to the force arrows illustrated in FIG. 6, it can be analyzed that, in addition to the stresses f1 and f2 applied by the spring 443, the side-push spring 444 presses the ball 446 through the baffle plate 445 to provide a lateral pushing force f3, so that the abutting portion 441*b* of the contact 441 is in more sufficient and reliable contact with the inner wall of the pin tubing 442. The arrow lines marked with 'I' in FIG. 6 schematically show the flow direction of the electric current. Referring to the trend of the electric current I indicated in FIG. 6, it can be analyzed that the electric current carried by the spring pin 404 is concentrated on the contact surface of the abutting portion 441*b* of the contact 441 and the inner wall of the pin tubing 442. In the aforementioned force applying mechanism, the ball 446 can roll freely as the contact 441 extends or retracts in the pin tubing 442. The aforementioned configuration of the force applying mechanism increases a contact area and a contact stress between an outer wall of the abutting portion 441*b* of the contact 441 and the inner wall of the pin tubing 442, so that the carried electric current flows mainly through the contact 441 and the pin tubing 442, thereby ensuring that contact impedance of the spring pin 404 is low and stable, which improves reliability of the spring pin both under static and dynamic conditions, and in particular eliminates electromagnetic radiation problems caused by fluctuations of the contact impedance. In an embodiment, the outer diameters of the side-push spring 444, the baffle plate 445 and the ball 446 are smaller than the inner diameter of the round blind hole 447 in the abutting portion 441*b* of the contact 441.

Meanwhile, referring to FIG. 6, the present disclosure also provides a spring pin for an X-ray tube device. The spring pin mainly includes a contact 441, a pin tubing 442 and a spring 443. The contact 441 has a head portion 441*a* and an abutting portion 441*b*, wherein the head portion 441*a* is in contact connection with the filament switch plug 402, and the abutting portion 441*b* defines an inclined surface 441*c*. The abutting portion 441*b* of the contact 441 is in contact connection with the inner wall of the pin tubing 442. The spring 443 is provided in the pin tubing 402 and elastically presses against the inclined surface 441*c* of the abutting portion 441*b*.

Further, as shown in FIG. 6, the spring pin 404 may further includes a force applying mechanism, which is formed in the abutting portion 441*b* of the contact 441 and used to drive the abutting portion 441*b* of the contact 441 to reliably contact and connect the inner wall of the pin tubing 442. Specifically, the force applying mechanism may include: a hole 447 in the abutting portion 441*b* of the contact 441; a spring 444 provided in the hole 447; a ball 446 provided in the hole 447 and in contact with the inner wall of the pin tubing 442; and a baffle plate 445 provided between the spring 444 and the ball 446; where one end of the spring 444 is in contact with the bottom of the hole 447, and the other end thereof is elastically abutted against the ball 446 by the baffle plate 445.

It can be seen from the above that, as compared with a conventional X-ray tube device, the X-ray tube device provided by the present disclosure reduces a volume of the closed X-ray tube, and simplifies an assembly structure of the filament lead so that it can provide a more stable and reliable X-ray beam.

Compared with the conventional spring pin, the spring pin provided by the present disclosure for the X-ray tube device introduces the side-push spring and the solid ball on the side of the contact column, which significantly improves the contact effect between the outer wall of the contact and the inner wall of the pin tubing, and the contact resistance becomes small and stable, thereby improving the capability and reliability of the spring pin in carrying electric current.

Therefore, the X-ray tube device provided by the present disclosure is light and compact, convenient in disassembling, flexible in use, stable in performance, and particularly suitable for the requirements of miniaturization, high efficiency and diversification of X-ray radiation imaging devices. It can be well integrated to those existing X-ray source equipments, without significant modifications or changes to those existed facilities.

Although some of the embodiments of the present general inventive concept have been illustrated and described, an ordinary person skilled in the art will understand that changes can be made to these embodiments without departing from the principles and spirit of the present general inventive concept. The scope of the present disclosure is defined by the claims and their equivalents.

What is claimed is:

1. An X-ray tube device, comprising:

an outer cylinder assembly having an anode end and a cathode end;

an anode end cap assembly provided at the anode end of the outer cylinder assembly and comprising an X-ray tube;

a cathode end cap assembly provided at the cathode end of the outer cylinder assembly and comprising a high voltage receptacle for connecting an external power supply; and a spring pin connection assembly provided within the outer cylinder assembly and configured to connect a filament lead of the X-ray tube to the high voltage receptacle, wherein the spring pin connection assembly comprises:

a filament switch receptacle connected to the filament lead of the X-ray tube;

a filament switch plug connected into the filament switch receptacle;

a spring pin switch receptacle connected to the high voltage receptacle; and a spring pin provided between the filament switch plug and the spring pin switch receptacle, and configured to connect the filament switch plug with the spring pin switch receptacle.

2. The X-ray tube device of claim 1, wherein the spring pin switch receptacle is provided with a mounting hole in which the spring pin is embedded, and a lead of the high voltage receptacle is welded to the spring pin.

3. The X-ray tube device of claim 1, wherein the filament switch plug and the spring pin are each made of a copper material plated with nickel and gold.

4. The X-ray tube device of claim 1, wherein the filament switch receptacle and the spring pin switch receptacle each are formed with a through hole.

5. The X-ray tube device of claim 1, wherein the spring pin comprises:

a contact having a head portion and an abutting portion, the head portion being in contact and connection with the filament switch plug, the abutting portion defining an inclined surface;

a pin tubing, wherein the abutting portion of the contact is in contact and connection with an inner wall of the pin tubing; and a spring provided in the pin tubing and elastically pressing against the inclined surface of the abutting portion.

6. The X-ray tube device of claim 5, wherein the spring pin further comprises a force applying mechanism formed in the abutting portion of the contact and configured to drive the abutting portion of the contact to reliably contact and connect the inner wall of the pin tubing, the force applying mechanism comprising:

a hole opened in the abutting portion of the contact;

a spring provided in the hole;

a ball provided in the hole and in contact with the inner wall of the pin tubing; and a baffle plate provided between the spring and the ball;

wherein one end of the spring is in contact with a bottom of the hole, while the other end thereof is elastically abutted against the ball via the baffle plate.

* * * * *